United States Patent [19]

Emdy

[11] Patent Number: 4,938,309

[45] Date of Patent: Jul. 3, 1990

[54] BUILT-IN VACUUM CLEANING SYSTEM WITH IMPROVED ACOUSTIC DAMPING DESIGN

[75] Inventor: Wayne Emdy, North Hollywood, Calif.

[73] Assignee: M.D. Manufacturing, Inc., Bakersfield, Calif.

[21] Appl. No.: 363,090

[22] Filed: Jun. 8, 1989

[51] Int. Cl.[5] ..... A47L 9/00; F01N 1/14; F01N 1/24

[52] U.S. Cl. ..... 181/231; 181/238; 181/258; 181/262; 181/264; 181/272; 15/326; 417/312; 55/276

[58] Field of Search ..... 181/202, 231, 238, 239, 181/258, 282, 262, 264, 272; 15/326; 55/276; 417/312

[56] References Cited

U.S. PATENT DOCUMENTS

| | | | |
|---|---|---|---|
| 2,948,210 | 8/1960 | Conlan | 181/239 X |
| 4,356,591 | 11/1982 | Lude | 181/231 X |
| 4,435,877 | 3/1984 | Berfield | 181/231 X |
| 4,786,299 | 11/1988 | DeMarco | 181/256 X |

*Primary Examiner*—Benjamin R. Fuller
*Attorney, Agent, or Firm*—Thomas I. Rozsa

[57] ABSTRACT

An improved design for the central power and suction unit of built-in vacuum cleaning systems, which improved design provides significant acoustic damping to substantially reduce the noise level generated from the central power and suction unit. The design further permits the canister of the central power and suction unit to rest on the floor. The motors of the central power unit are enclosed within an interior chamber which includes at its lower end a baffle supporting an acoustic damper such as acoustic foam and the interior chamber is vented through exhaust ports the tips of the armatures are separated from the remainder of the armatures and motors by the baffle and the tips of the armatures extend into another chamber which further includes a second acoustic damper within the chamber and further includes openings for permitting cooling air to enter the chamber. Through this design, the noise level generated from the motors is very substantially reduced while the motors are sufficiently cooled.

42 Claims, 3 Drawing Sheets

Fig. 1.
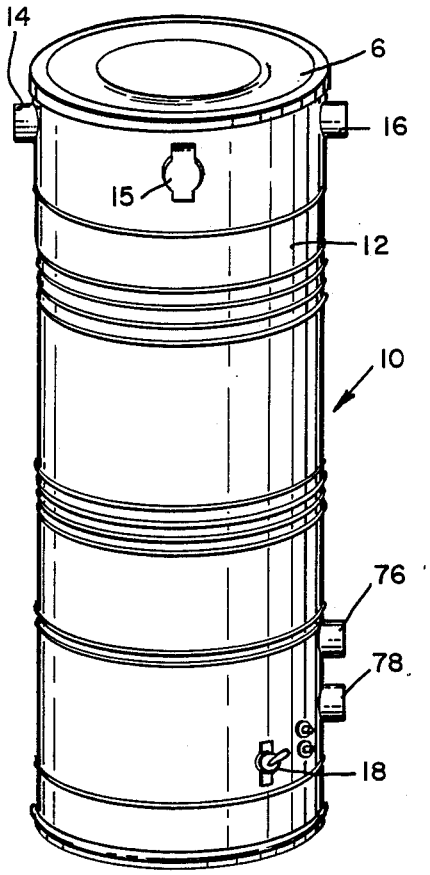
Fig. 2.
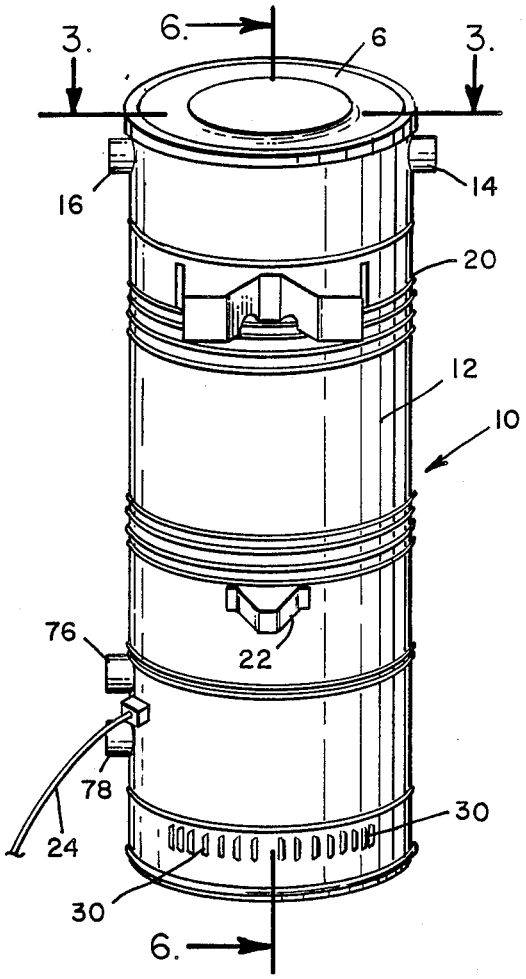
Fig. 3.
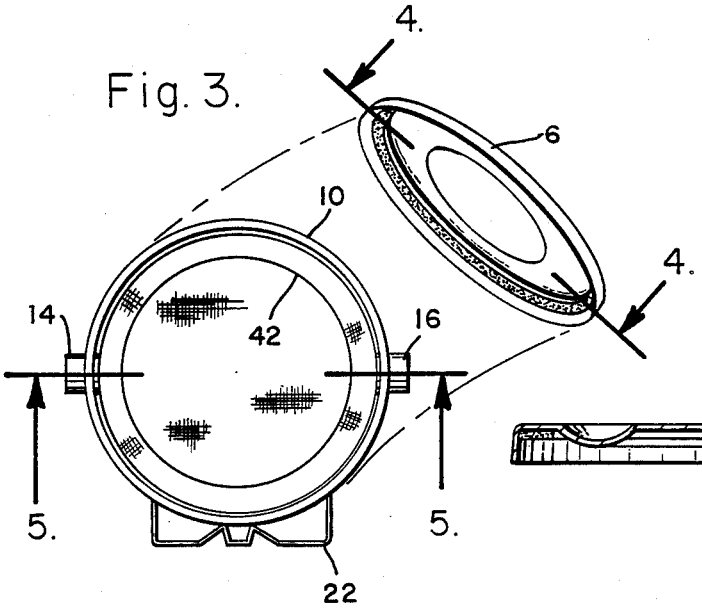
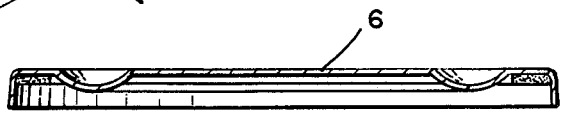
Fig. 4.

Fig. 5.
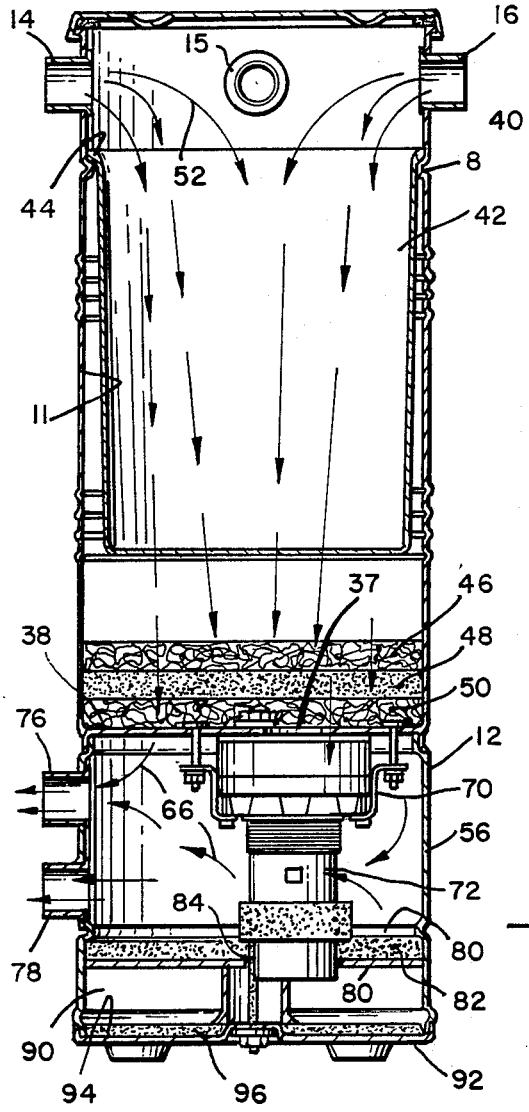
Fig. 6.
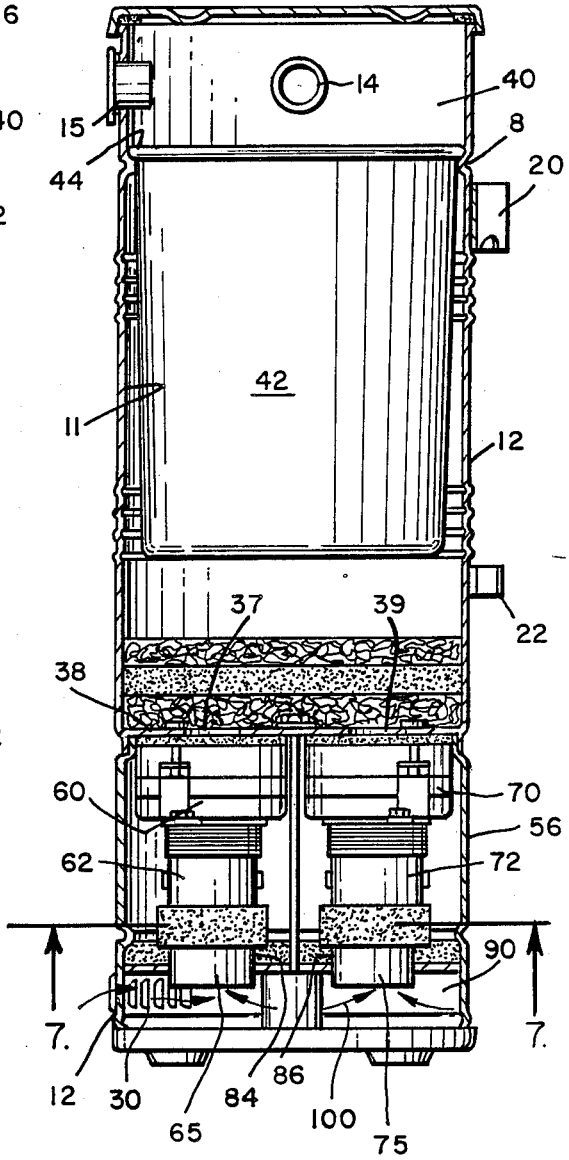
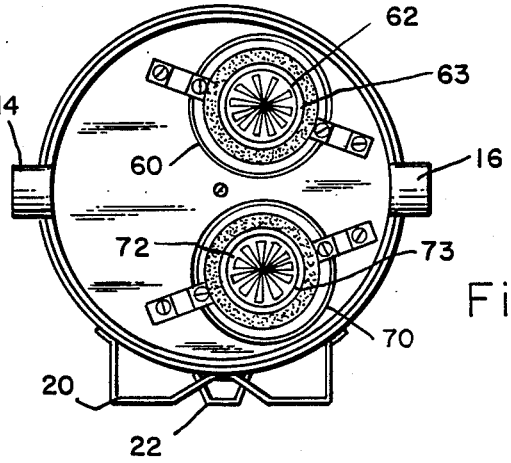
Fig. 7.

Fig. 9.
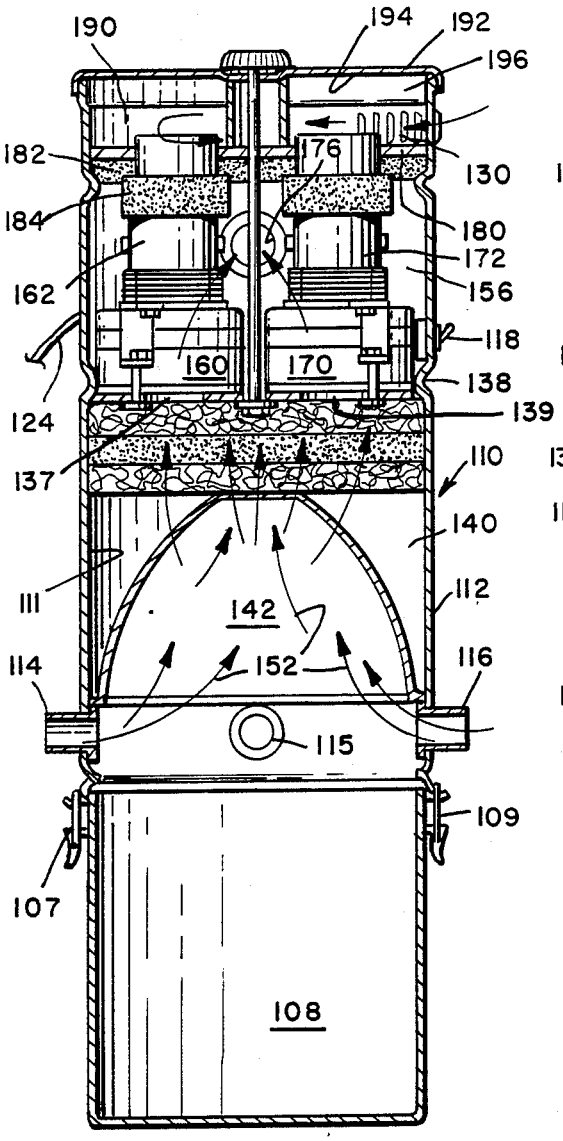
Fig. 8.
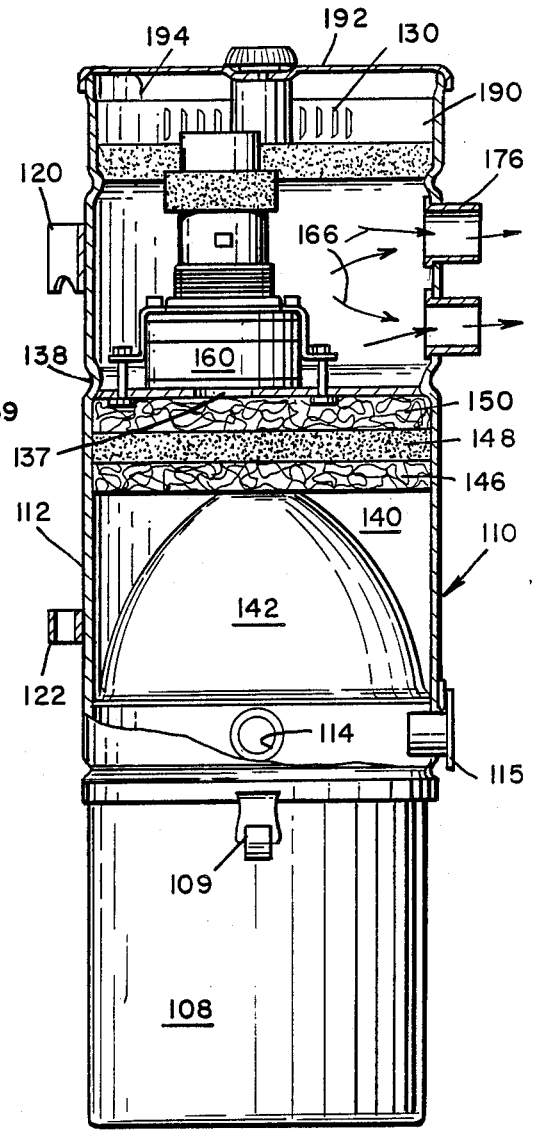
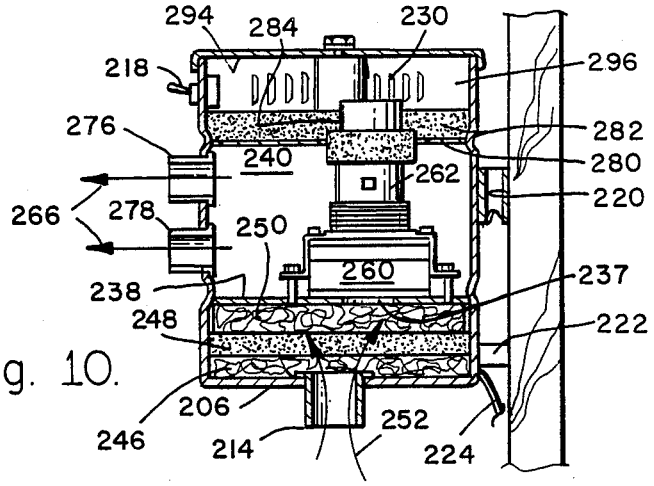
Fig. 10.

BUILT-IN VACUUM CLEANING SYSTEM WITH IMPROVED ACOUSTIC DAMPING DESIGN

BACKGROUND OF THE INVENTION

1. Field of the Invention

The field of the present invention relates to built-in vacuum cleaning systems in which a central motor, suction, waste catching and disposal unit serve as the central power source and a system of vacuum ducts extends into various rooms of the house A vacuum inlet is located in the wall of the selected rooms and the vacuum hose is connected to the suction inlet. The central vacuum system thereby reduces the necessity of carrying the vacuum cleaner from room to room. The field of the present invention further relates to an improved vacuum cleaner acoustic damming system which serves to substantially reduce the noise level generated by the central power and suction source.

2. Description of the Prior Art

In general, built-in vacuum cleaning systems are well known in the prior art. One example of the state of the art prior art units is the "Modern Day" built-in vacuum cleaning system manufactured by M.D. Manufacturing Co. . A copy of a brochure describing this system is being submitted with this application. The unit comprises a central motor, suction, waste catching and disposal unit which serves as the central power and suction source. The unit is attached through a suction hose into a central suction gathering duct which in turn extends through a network of suction ducts, a respective one of which terminates in a vacuum inlet in the various rooms of the home. When not in use, the suction inlet is covered by a plate. In use, the vacuum inlet is opened and the vacuum hose is plugged into the suction inlet. The central power source is activated and the suction force draws in dirt and dust through the vacuum cleaner nozzle attached at the end of the vacuum hose. The system can be used on any type of surface: all carpeting, wood, and tile floors, plus draperies, furniture, crevices, corners, staircases etc. The powerful central suction unit provides substantially more cleaning power than conventional portable vacuum cleaners. Another advantage of the central system is that it eliminates the re-circulation of unhealthy germ-laden air. Unlike portable vacuum cleaners, all the exhaust air is vented outside the living area.

One major disadvantage of the built-in vacuum systems known in the prior art is the creation of a very substantial amount of noise by the central power and suction unit. In most conventional units known in the prior art, the noise level generated from the central power and suction unit lies in the range of 85 to 96 decibels In addition, the exhaust from hot air from the motor armature is situated in openings located in the bottom of the power unit canister, thereby requiring that power unit to be lifted up off the ground and set on blocks or mounted high on a wall. Even though the central power and suction unit is located in a remote area such as the basement or garage of the home, many people prefer to use such locations as playrooms, workshops, etc. It is almost impossible to comfortably work in such locations when the central power and suction unit is running, as the high noise level is sometimes deafening and at best extremely irritating. The prior art design with the exhaust openings in the bottom also make for increased difficulty in the placement of the unit.

Therefore a significant need exists for an improved built-in vacuum cleaning system with improved exhaust design and substantially improved acoustic damping system to significantly lower the noise level generated from the central power and suction unit.

SUMMARY OF THE PRESENT INVENTION

The present invention relates to an improved design for the central power and suction unit of built-in vacuum cleaning systems, which improved design provides significant acoustic damping to substantially reduce the noise level generated from the central power and suction unit. The improved design further permits the canister of the central power and suction unit to rest on the floor.

It has been discovered, according to the present invention, that if the motors of the central power unit are enclosed within an interior chamber which includes at its lower end a baffle supporting an acoustic damping means such as acoustic foam, and the interior chamber is vented through exhaust ports which permit the hot air from the motors to be exhausted, then the noise level generated from the motors is very substantially reduced while the motors are sufficiently cooled.

It has further been discovered, according to the present invention, that if the tips of the armatures are separated from the remainder of the armatures and motors by the baffle and the tips of the armatures extend into another chamber which further comprises a second acoustic damping means such as acoustic foam within the chamber and further includes means for permitting cooling air to enter the chamber such as louvres in the wall of the chamber, then the noise from the motors and armatures is reduced even further, thereby resulting in a very significant noise reduction from almost 85 to 96 decibels down to approximately 60 decibels.

It is therefore an object of the present invention to provide improvements in the central power unit of built-in vacuum systems which will very substantially reduce the noise from the vacuum units.

It is a further object of the present invention to provide such a damping system which will accommodate conventional power unit canister designs and further accommodate conventional configurations for the placement of the power unit motors and armatures.

It is an additional object of the present invention to provide substantially enhanced noise dampening to the power unit while at the same time providing sufficient venting to assure that the armatures of the motors will be cooled by incoming cooling air and the hot air from the motors can be efficiently exhausted.

Further novel features and other objects of the present invention will become apparent from the following detailed description discussion and the appended claims taken in conjunction with the drawings.

BRIEF DESCRIPTION OF THE DRAWINGS

Referring to the drawings for the purpose of illustration only and not limitation, there is illustrated:

FIG. 1 is a front elevational view of the preferred embodiment of the central power and suction unit canister of the present invention.

FIG. 2 is a rear elevational view of the preferred embodiment of the central power and suction unit canister of the present invention.

FIG. 3 is a top plan view with the cover removed on the preferred embodiment of the central power and suction unit of the present invention. The removed cover is shown to the right of the unit.

FIG. 4 is a cross-sectional view of the cover of the canister of the central power and suction unit, taken along line 4—4 of FIG. 3.

FIG. 5 is a longitudinal cross-sectional view looking from the front of the preferred embodiment of the central power and suction unit illustrating the improvements of the present invention therein.

FIG. 6 is a longitudinal cross-sectional view looking from the side of the preferred embodiment of the central power and suction unit, illustrating the improvements of the present invention therein.

FIG. 7 is a cross-sectional view looking from the bottom taken along line 7—7 of FIG. 6.

FIG. 8 is a longitudinal cross-sectional view looking from the front of an alternative embodiment of the central power and suction unit, illustrating the improvements of the present invention therein.

FIG. 9 is a longitudinal cross-sectional view looking from the side of an alternative embodiment of the central power and suction unit illustrating the improvements of the present invention therein.

FIG. 10 is a longitudinal cross-sectional view looking from the front of another alternative embodiment of the central power and suction unit, illustrating the improvements of the present invention therein.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

In summary, the present invention is an improved design for the central power and suction unit of built-in vacuum cleaning systems which improved design provides significant acoustic damping to substantiallY reduce the noise level generated from the central power and suction unit. The design further permits the canister of the central power and suction unit to rest on the floor. The motors of the central power unit are enclosed within an interior chamber which includes at its lower end a baffle supporting an acoustic damper such as acoustic foam and the interior chamber is vented through exhaust ports. The tips of the armatures are separated from the remainder of the armatures and motors by the baffle and the tips of the armatures extend into another chamber which further includes a second acoustic damper within the chamber and further includes openings for permitting cooling air to enter the chamber. Through this design, the noise level generated from the motors is very substantially reduced while the motors are sufficiently cooled.

Referring particularly to FIG. 1, there is shown at 10 the canister housing the central power and suction unit for the built-in vacuum cleaning system of the present invention. The cylindrical sidewall 12 has a pair of air intake ports 14 and 16 located adjacent the top 6 of the canister. Also located adjacent the top of the canister is a vacuum hose attachment inlet 15. An on-off switch 18 is located adjacent the bottom of the canister. A pair of exhaust ports 76 and 78 are vertically aligned and are located adjacent the bottom of the canister. An upper bracket 20 and a lower bracket 22 are vertically aligned along the rear face of the side wall 12 and provide optional attachment means by which the canister 10 can be mounted on a wall. A power cord 24 connects the central power and suction unit 10 to an electrical power source. Located in the sidewall 12 adjacent the bottom of the canister 10 are a multiplicity of exhaust louvres 30. The top 6 of the canister is illustrated in greater detail in FIG. 4, and is removable to expose the dust collection chamber and receptacle, as illustrated in FIG. 3.

Referring to FIG. 5, the canister 10 comprises an upper interior hollow compartment 40 which houses within it a removable dirt and dust collection bag 42. The bag 42 has an upper rim 44 which rests on an interior ledge 8 of interior canister wall 11. Below the dirt and dust collection bag 42 are a multiplicity of filters. In the preferred embodiment, there are three filter; a first coarse filter 46, a fine filter 48 and a second coarse filter 50. The interior chamber 40 has a partition base 38. The second coarse filter 50 rests against partition base 38. As can be seen by the flow arrows 52, suction created by the motor causes a flow of air into the interior chamber 40 of canister 10 and creates a suction which draws dirt, dust and other particulates into the collection bag 42. Since the bag is porous to allow air flow through it, the filters 46, 48 and 50 serve to trap any escaped dirt and dust so that it will not damage the motor. The portion described so far, except for the louvres 30 in the sidewall 12 and vertically aligned exhaust ports 76 and 78 are conventional items which are known in prior art central power and suction unit designs.

The present invention central power and suction unit 10 can operate with any multiplicity of motors within its design. At least one motor and armature is required for the power unit. Conventionally, either one, two or three motors are used. In the preferred embodiment as illustrated in FIGS. 5 through 7, two motors are used. The motors are housed in second interior compartment 56 which lies below upper interior hollow compartment 40 and is separated from it by partition base 38. First motor 60 has an armature 62. A first opening 37 in partition base 38 leads to first motor 60 from upper interior hollow compartment 40. Second motor 70 has an armature 72. A second opening 39 in partition base 38 leads to second motor 70 from upper interior hollow compartment 40. The first and second motors 60 and 70 by way of example can be 120 volt one and one-quarter ($1\frac{1}{4}$) horsepower suction motors. One feature of the present invention is the inclusion of a pair of exhaust ports 76 and 78 in canister sidewall 12. The exhaust ports 76 and 78 are preferably vertically aligned, extend into second interior compartment 56, and are situated on the side of the canister away from the location of the two motors 60 and 70. As can be seen by the flow arrows 66, the exhaust ports 76 and 78 are important to provide an exit for the hot exhaust air from the motor armatures 62 and 72 respectively.

The significant improvement of the present invention lies in the inclusion of a pair of acoustic damping means which significantly dampen the noise from the motors. The first addition is the inclusion of a baffle 80 which supports a first acoustic damping means 82. The first acoustic damping means 82 is preferably acoustic foam which by way of example can be approximately one-half (½) inch thick. Both the baffle 80 and the acoustic foam 82 have a pair of openings 84 and 86 which permit the armatures 62 and 72 of motors 60 and 70 respectively to extend through a respective one of the openings. Armature 62 extends through first opening 84 and armature 72 extends through second opening 86. The ends of the armatures 62 and 72 extend into an interior acoustic damping chamber 90 which is separated from the second interior compartment 56 by the baffle 80 and first damping means 82. Referring to FIG. 7, first armature 62 is surrounded by a retaining member 63 and second armature 72 is surrounded by a retaining member 73. The two retaining members 63 and 73 are affixed to the side of the baffle 80 remote from the first acoustic damping means 82. The interior acoustic damping chamber 90 is closed by the bottom 92 of canister 10. In the interior surface 94 of bottom 92 is affixed a second acoustic damping means 96. By way of example the second acoustic damping means 96 can also be acoustic foam which is approximately one-half (½) inch thick. Therefore, the acoustic damping chamber 90 which is surrounding by first acoustic damping means 82 on the top (immediately above baffle 80) and second acoustic damping means 96 which rests above bottom 92 and within the acoustic damping chamber 90 serves to very substantially reduce the noise generated from the motors 60 and 70 and their respective armatures 62 and 72. It has been determined that the motors which ordinarily generate an exterior noise level in the range of 85 to 96 decibels are reduced to an exterior noise level of approximately 60 decibels through inclusion of the present invention damping means.

Referring to FIG. 6, the exterior wall 12 of canister 10 in the location of acoustic damping chamber 90 also comprises a multiplicity of louvres 30. As illustrated by arrows 100, the louvres 30 serve to permit cooling air to enter the acoustic damping chamber 90 to cool armatures 62 and 72.

Therefore, through use of the present invention design, the motors 60 and 70 are separated into a second interior chamber 56 by the baffle 80 and first acoustic damping means 82 which serves to substantially dampen the noise of the motors 60 and 70 and the motors can be maintained in a cool and operable condition through the inclusion of exhaust ports 76 and 78 in the wall 12 of canister 10 in the location of and extending into second interior chamber 56. In addition, the tips 65 and 75 of armatures 62 and 72 respectively are caused to extend into an acoustic damping chamber 90 created between the baffle 80 and the bottom 92 of the canister 10. The acoustic damping chamber 90 surrounded by the baffle 80 and second acoustic damping means 96 serves to further very substantially dampen the noise from the motors and armatures. The result is a very significant reduction in noise level from 85 to 96 decibels down to approximately 60 decibels. As a result, an individual can comfortably work in the area when the central power and suction unit is operating.

Defined more broadly the present invention is an improved power unit for a vacuum cleaning system including a canister having a sidewall, a top and a bottom, an upper interior hollow compartment housing a removable dirt and dust collection receptacle and including a partition base which separates the upper interior hollow compartment from a second interior compartment which houses at least one motor and armature interiorly extending therefrom, the improvement comprising: (a) a baffle within said canister positioned to define one end of said second interior compartment; (b) a first acoustic damping means supported on said baffle; (c) a second acoustic damping means supported on said bottom of said canister; (d) said sidewall, said baffle and said second acoustic damping means defining an acoustic damping chamber; (e) said baffle and said first acoustic damping means comprising at least one opening to permit a portion of the armature of said at least one motor to extend through the baffle and first acoustic damping means into said acoustic damping chamber; (f) exhaust means in said sidewall to permit hot air exhaust from said at least one motor to exit said second interior compartment; and (g) air intake means in said sidewall to permit cooling air to enter said acoustic damping chamber; (h) whereby said first acoustic damping means and said second acoustic damping means reduce the noise emitted from said at least one motor.

Defined even more broadly, thr present invention is an improved power unit for a vacuum cleaning system including a canister having a sidewall, a top and a bottom, an upper interior hollow compartment housing a removable dirt and dust collection receptacle and including a partition base which separates the upper interior hollow compartment from a second interior compartment which houses at least one motor and armature interiorly extending therefrom, the improvement comprising: (a) first damping means defining one end of said second interior compartment to thereby house said at least one motor between said partition base and the first damping means; (b) second damping means spaced apart from said first damping means whereby said sidewall, said first damping means and said second damping means define an acoustic damping chamber; (c) said first damping means comprising at least one opening to permit a portion of the armature of said at least one motor to extend through said first damping means into said acoustic damping chamber; (d) exhaust means in said sidewall to permit hot air exhaust from said at least one motor to exit said second interior compartment; and (e) air intake means in said sidewall to permit cooling air to enter said acoustic damping chamber; (f) whereby said first damping means and said second damping means reduce the noise emitted from said at least one motor.

In the preferred embodiment of the present invention, the motors and the noise damping system were located adjacent the bottom of the canister. In some applications, the central suction vacuum cleaner assembly is designed with the motors adjacent the top of the canister. The principals of the present invention are the same with the motors adjacent the top rather than the bottom of the canister. The alternative embodiment of the present invention with the motors adjacent the top of the canister is illustrated in FIGS. 8 and 9.

Referring particularly to FIGS. 8 and 9, there is shown at 110 the canister housing the central power and suction unit for the alternative embodiment of the built-in vacuum cleaning system of the present invention. The cylindrical sidewall 112 has a pair of air intake ports 114 and 116 located about one third of the way between the bottom and top of the canister 110 and being closer to the bottom. Also located in the same horizontal plane as the air intakes is a vacuum hose attachment inlet 115. An on-off switch 118 is located adjacent the top of the canister. A pair of exhaust ports 176 and 178 are vertically aligned and are located adjacent the top of the canister. An upper bracket 120 and a lower bracket 122 are vertically aligned along the rear face of the side wall 112 and provide optional attachment means by which the canister 110 can be mounted on a wall. A power cord 124 connects the central power and suction unit 110 to an electrical power source. Located in the sidewall 112 adjacent the top of the canister 110 are a multiplicity of exhaust louvres 130.

The canister 110 comprises a lower hollow bottom section 108 which is attached to the remainder of the canister 110 by attachment means such as snap clips 107 and 109. The canister 110 comprises a first interior hollow compartment 140 which houses within it a removable dirt and dust collection bag 142. The bag 142 has a lower rim 144 which rests on an interior ledge 106 of interior canister wall 111. The collection bag 142 is upside down and dirt which enters through air intakes 114 and 116 is blocked by the bag 142 which then causes the dirt to settle in the lower hollow bottom section 108. When the section 108 is filled with dirt, the snap clips 107 and 109 can be opened and the lower bottom hollow section 108 can be removed and the dirt emptied. Above the dirt and dust collection and blocking bag 142 are a multiplicity of filters. In the preferred embodiment, there are three filters; a first coarse filter 146, a fine filter 148 and a second coarse filter 150. The interior chamber 140 has a partition base 138. The second coarse filter 150 rests against partition base 138. As can be seen by the flow arrows 152, suction created by the motor causes a flow of air into the interior chamber 140 of canister 110 and creates a suction which draws dirt, dust and other particulates into the collection bag 142 and which then drop into lower section 108. Since the bag is porous to allow air flow through it, the filters 146, 148 and 150 serve to trap any escaped dirt and dust so that it will not damage the motor. The portion described so far, except for the louvres 130 in the sidewall 112 and vertically aligned exhaust ports 176 and 178 are conventional items which are known in prior art central power and suction unit designs.

The present invention central power and suction unit 110 can operate with any multiplicity of motors within its design. At least one motor and armature is required for the power unit. Conventionally, either one, two or three motors are used. In the alternative embodiment as illustrated in FIGS. 8 and 9, two motors are used. The motors are housed in second interior compartment 156 which lies above first interior hollow compartment 140 and is separated from it by partition base 138. First motor 160 has an armature 162. A first opening 137 in partition base 138 leads to first motor 160 from interior hollow compartment 140. Second motor 170 has an armature 172. A second opening 139 in partition base 138 leads to second motor 170 from first interior hollow compartment 140. The first and second motors 160 and 170 by way of example can be 120 volt one and one-quarter (1¼) horsepower suction motors. One feature of the present invention is the inclusion of a pair of exhaust ports 176 and 178 in canister sidewall 112. The exhaust ports 176 and 178 are preferably vertically aligned, extend into second interior compartment 156, and are situated on the side of the canister away from the location of the two motors 160 and 170. As can be seen by the flow arrows 166, the exhaust ports 176 and 178 are important to provide an exit for the hot exhaust air from the motor armatures 162 and 172 respectively.

The significant improvement of the present invention lies in the inclusion of a pair of acoustic damping means which significantly dampen the noise from the motors. The first addition is the inclusion of a baffle 180 which supports a first acoustic damping means 182. The first acoustic damping means 182 is preferably acoustic foam which by way of example can be approximately one-half (½) inch thick. Both the baffle 180 and the acoustic foam 182 have a pair of openings 184 and 186 which permit the armatures 162 and 172 of motors 160 and 170 respectively to extend through a respective one of the openings Armature 162 extends through first opening 184 and armature 172 extends through second opening 186. The ends of the armatures 162 and 172 extend into an interior acoustic damping chamber 190 which is separated from the second interior compartment 156 by the baffle 180 and first damping means 182. Comparable to the embodiment illustrated in FIG. 7, first armature 162 is surrounded by a retaining member and second armature 172 is surrounded by a retaining member. The two retaining members are affixed to the side of the baffle 180 remote from the first acoustic damping means 182. The interior acoustic damping chamber 190 is closed by the top 192 of canister 110. In the interior surface 194 of bottom 192 is affixed a second acoustic damping means 196. By way of example, the second acoustic damping means 196 can also be acoustic foam which is approximately one-half (½) inch thick. Therefore, the acoustic damping chamber 190 which is surrounded by first acoustic damping means !82 on the bottom (immediately below baffle 180) and second acoustic damping means 196 which rests below top 192 and within the acoustic damping chamber 190 serves to very substantially reduce the noise generated from the motors 160 and 170 and their respective armatures 162 and 172. It has been determined that the motors which ordinarily generate an exterior noise level in the range of 85 to 96 decibels are reduced to an exterior noise level of approximately 60 decibels through inclusion of the present invention damping means.

Defined more broadly, the alternative embodiment of the present invention is an improved power unit for a vacuum cleaning system including a canister having a sidewall, a top and a bottom hollow section, a first interior hollow compartment housing a removable dirt and dust collection receptacle which causes dirt and dust to fall into the bottom hollow section and including a partition base which separates the first interior hollow compartment from a second interior compartment located near the top of said canister and which houses at least one motor and armature interiorly extending therefrom, the improvement comprising: (a) a baffle within said canister positioned to define one end of said second interior compartment; (b) a first acoustic damping means supported on said baffle; (c) a second acoustic damping means supported on and below said top of said canister; (d) said sidewall, said baffle and said second acoustic damping means defining an acoustic damping chamber; (e) said baffle and said first acoustic damping means comprising at least one opening to permit a portion of the armature of said at least one motor to extend through the baffle and first acoustic damping means into said acoustic damping chamber; (f) exhaust means in said sidewall to permit hot air exhaust from said at least one motor to exit said second interior compartment; and (g) air intake means in said sidewall to permit cooling air to enter said acoustic damping chamber; (h) whereby said first acoustic damping means and said second acoustic damping means reduce the noise emitted from said at least one motor.

Defined even more broadly, the present invention is an improved power unit for a vacuum cleaning system including a canister having a sidewall, a top and a bottom hollow section, a first interior hollow compartment housing a removable dirt and dust collection receptacle which causes dirt and dust to fall into the bottom hollow section and including a partition base which separates the first interior hollow compartment from a second interior compartment located near the top of said canister and which houses at least one motor and armature interiorly extending therefrom, the improvement comprising: (a) first damping means defining one end of said second interior compartment to thereby house said at least one motor between said partition base and the first damping means; (b) second damping means spaced apart from said first damping means whereby said sidewall, said first damping means and said second damping means define an acoustic damping chamber; (c) said first damping means comprising at least one opening to permit a portion of the armature of said at least one motor to extend through said first damping means into said acoustic damping chamber; (d) exhaust means in said sidewall to permit hot air exhaust from said at least one motor to exit said second interior compartment; and (e) air intake means in said sidewall to permit cooling air to enter said acoustic damping chamber; (f) whereby said first damping means and said second damping means reduce the noise emitted from said at least one motor.

In some embodiments of central suction units, the dirt and dust collection section is housed separately from the motor compartment. In this embodiment, the motor compartment is housed by itself on the wall and the present invention focuses strictly on this motor compartment This is illustrated in FIG. 10.

Referring particularly to FIG. 10, there is shown at 210 the canister housing the central power and suction unit for the alternative embodiment of the built-in vacuum cleaning system of the present invention having the power unit by itself. An intake port 214 leads from the separate dirt and dust collection canister (not shown) into the power canister 210. The canister 210 has a sidewall 212. An on-off switch 218 is located on the canister. A pair of exhaust ports 276 and 278 are vertically aligned and are located at the mid area of the canister. An upper bracket 220 and a lower bracket 222 are vertically aligned along the rear face of the sidewall 212 and provide optional attachment means by which the canister 210 can be mounted on a wall. A power cord 224 connects the central poWer and suction unit 210 to an electrical power source. Located in the sidewall 212 adjacent the top of the canister 210 are a multiplicity of exhaust louvres 230.

Above the intake port 214 are a multiplicity of filters. In the preferred embodiment, there are three filters; a first coarse filter 246, a fine filter 248 and a second coarse filter 250. The canister 210 has an interior chamber 240 and the three filters rest between the bottom 206 of canister 210 and an interior partition base 238. First coarse filter 246 rests on bottom 206 and second coarse filter 25 rests beneath partition base 238. As can be seen by the flow arrows 252, suction created by the motor causes a flow of air into the canister 210 and the filters 246, 248 and 250 serve to trap any escaped dirt and dust so that it will not damage the motor. The portion described so far, except for the louvres 230 in the sidewall 212 and vertically aligned cooling ports 276 and 278 are conventional items which are known in prior art central power and suction unit designs.

The present invention central power and suction unit 210 can operate with any multiplicity of motors within its design. At least one motor and armature is required for the power unit. Conventionally, either one, two or three motors are used. In the alternative embodiment as illustrated in FIG. 10, one motor is used. The motor is housed in interior compartment 240. Motor 260 has an armature 262. An opening 237 in partition base 238 leads to the motor 260 from interior hollow compartment 240. The motor 260 by way of example can be a 120 volt one and one-quarter ($1\frac{1}{4}$) horsepower suction motor. One feature of the present invention is the inclusion of a pair of exhaust ports 276 and 278 in canister sidewall 212. The exhaust ports 276 and 278 are preferably vertically aligned, extend into interior compartment 240, and are situated on the side of the canister away from the location of the motor 260. As can be seen by the flow arrows 266, the exhaust ports 276 and 278 are important to provide an exit for the hot exhaust air from the motor armature 262.

The significant improvement of the present invention lies in the inclusion of a pair of acoustic damping means which significantly dampen the noise from the motors. The first addition is the inclusion of a baffle 280 which supports a first acoustic damping means 282. The first acoustic damping means 282 is preferably acoustic foam which by way of example can be approximately one-half ($\frac{1}{2}$) inch thick. Both the baffle 280 and the acoustic foam 282 have an opening 284 which permits the armature 262 of motor 260 to extend through the opening. The end of the armature 262 extends into an interior acoustic damping chamber 290 which is separated from the interior compartment 240 by the baffle 280 and first damping means 282. Comparable to the embodiment illustrated in FIG. 7, armature 262 is surrounded by a retaining member. The retaining member is affixed to the side of the baffle 280 remote from the first acoustic damping means 282. The interior acoustic damping chamber 290 is closed by the top 292 of canister 210. In the interior surface 294 of top 292 is affixed a second acoustic damping means 296. By way of example, the second acoustic damping means 296 can also be acoustic foam which is approximately one-half ($\frac{1}{2}$) inch thick. Therefore, the acoustic damping chamber 290 which is surrounded by first acoustic damping means 282 on the bottom (immediately below baffle 280) and second acoustic damping means 296 which rests below top 292 and within the acoustic damping chamber 290 serves to very substantially reduce the noise generated from the motor 260 and its respective armature 262. It has been determined that the motor which ordinarily generates an exterior noise level in the range of 85 to 96 decibels is reduced to an exterior noise level of approximately 60 decibels through inclusion of the present invention damping means.

Defined more broadly, the alternative embodiment of the present invention is an improved power unit for a vacuum cleaning system including a canister having a sidewall, a top and a bottom, an inlet port to receive air from a separate dirt and dust collection means, a partition base within the chamber the interior chamber housing at least one motor and armature interiorly extending therefrom, the improvement comprising: (a) baffle within said canister positioned to define one end of said second interior compartment; (b) a first acoustic damping means supported on said baffle, (c) a second acoustic damping means supported on and below said top of said canister; (d) said sidewall, said baffle and said second acoustic damping means defining an acoustic damping chamber; (e) said baffle and said first acoustic damping means comprising at least one opening to permit a portion of the armature of said at least one motor to extend through the baffle and first acoustic damping means into said acoustic damping chamber; (f) exhaust means in said sidewall to permit hot air exhaust from said at least one motor to exit said interior chamber; and (g) air intake means in said sidewall to permit cooling air to enter said acoustic damping chamber; (h) whereby said first acoustic damping means and said second acoustic damping means reduce the noise emitted from said at least one motor Defined even more broadly, the present invention is an improved power unit for a vacuum cleaning system including a canister having a sidewall, a top and a bottom, an inlet port to receive air from a separate dirt and dust collection means, a partition base within the chamber, the interior chamber housing at least one motor and armature interiorly extending therefrom, the improvement comprising: (a) first damping means defining one end of said second interior compartment to thereby house said at least one motor between said partition base and the first damping means; (b) second damping means spaced apart from said first damping means whereby said sidewall, said first damping means and said second damping means define an acoustic damping chamber; (c) said first damping means comprising at least one opening to permit a portion of the armature of said at least one motor to extend through said first damping means into said acoustic damping chamber; (d) exhaust means in said sidewall to permit hot air exhaust from said at least one motor to exit said interior chamber; and (e) air intake means in said sidewall to permit cooling air to enter said acoustic damping chamber; (f) whereby said first damping means and said second damping means reduce the noise emitted from said at least one motor.

Of course the present invention is not intended to be resticted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An improved power unit for a vacuum cleaning system including a canister having a sidewall, a top and a bottom, an upper interior hollow compartment housing a removable dirt and dust collection receptacle and including a partition base which separates the upper and interior hollow compartment from a second interior compartment which houses at least one motor and armature interiorly extending therefrom, with the at least one motor emitting noise when the at least one motor is turned on, the improvement comprising:

a. a baffle within said canister positioned to define one end of said second interior compartment;
b. a first acoustic damping means supported on said baffle;
c. a second acoustic damping means supported on said bottom of said canister;
d. said sidewall, said baffle and said second acoustic camping means defining an acoustic damping chamber;
e. said baffle and said first acoustic damping means comprising at least one opening to permit a portion of the armature of said at least one motor to extend through the baffle and first acoustic damping means into said acoustic damping chamber;
f. exhaust means in said sidewall to permit hot air exhaust from said at least one motor to exit said second interior compartment; and
g. air intake means in said sidewall to permit cooling air to enter said acoustic damping chamber;
h. whereby said first acoustic damping means and said second acoustic damping means reduce the noise emitted from said at least one motor.

2. An improved power unit for a vacuum cleaning system in accordance with claim 1 wherein said first acoustic damping means is acoustic foam and said second acoustic damping means is acoustic foam.

3. An improved power unit for a vacuum cleaning system in accordance with claim 2 wherein said acoustic foam of said first acoustic damping means is approximately one-half inch thick and said acoustic foam of said second acoustic damping means is approximately one-half inch thick.

4. An improved power unit for a vacuum cleaning system in accordance with claim 1 wherein said exhaust means is at least one exhaust port located in said sidewall and extending into said second interior compartment at a location remote from where said at least one motor and armature is located.

5. An improved power unit for a vacuum cleaning system in accordance with claim 1 wherein said exhaust means is a pair of vertically aligned exhaust ports, each of which is located in said sidewall and extending into said second interior compartment at a location remote from where said at least one motor and armature is located.

6. An improved power unit for a vacuum cleaning system in accordance with claim 1 wherein said air intake means are louvres in the sidewall at the location of said acoustic damping chamber.

7. An improved power unit for a vacuum cleaning system including a canister having a sidewall, a top and a bottom, an upper interior hollow compartment housing a removable dirt and dust collection receptacle and including a partition base which separates the upper interior hollow compartment from a second interior compartment which houses at least one motor and armature interiorly extending therefrom, with the at least one motor emitting noise when the at least one motor is turned on, the improvement comprising:

a. first damping means defining one end of said second interior compartment to thereby house said at least one motor between said partition base and the first damping means;
b. second damping means spaced apart from said first damping means whereby said sidewall, said first damping means and said second damping means define an acoustic damping chamber;

c. said first damping means comprising at least one opening to permit a portion of the armature of said at least one motor to extend through said first damping means into said acoustic damping chamber;

d. exhaust means in said sidewall to permit hot air exhaust from said at least one motor to exit said second interior compartment; and e. air intake means in said sidewall to permit cooling air to enter said acoustic damping chamber;

f. whereby said first damping means and said second damping means reduce the noise emitted from said at least one motor.

8. An improved power unit for a vacuum cleaning system in accordance with claim 7 wherein said first damping means further comprises a baffle supporting acoustic foam.

9. An improved power unit for a vacuum cleaning system in accordance with claim 8 wherein said acoustic foam is approximately one-half inch thick.

10. An improved power unit for a vacuum cleaning system in accordance with claim 7 wherein said second damping means further comprises acoustic foam supported on said base.

11. An improved power unit for a vacuum cleaning system in accordance with claim 10 wherein said acoustic foam is approximately one-half inch thick.

12. An improved power unit for a vacuum cleaning system in accordance with claim 7 wherein said exhaust means is at least one exhaust port located in said sidewall and extending into said second interior compartment at a location remote from where said at least one motor and armature is located.

13. An improved power unit for a vacuum cleaning system in accordance with claim 7 wherein said exhaust means is a pair of vertically aligned exhaust ports, each of which is located in said sidewall and extending into said second interior compartment at a location remote from where said at least one motor and armature is located.

14. An improved power unit for a vacuum cleaning system in accordance with claim 7 wherein said air intake means are louvres in the sidewall at the location of said acoustic damping chamber.

15. An improved power unit for a vacuum cleaning system including a canister having a sidewall, a top and a bottom hollow section, a first interior hollow compartment housing removable dirt and dust collection receptacle which causes dirt and dust to fall into the bottom hollow section and including a partition base which separates the first interior hollow compartment from a second interior compartment located near the top of said canister and which houses at least one motor and armature interiorly extending therefrom, with the at least one motor emitting noise when the at least one motor is turned on, the improvement comprising:

a. a baffle within said canister positioned to define one end of said second interior compartment;

b. a first acoustic damping means supported on said baffle;

c. a second acoustic damping means supported on and below said top of said canister;

d. said sidewall, said baffle and said second acoustic damping means defining an acoustic damping chamber;

e. said baffle and said first acoustic damping means comprising at least one opening to permit a portion of the armature of said at least one motor to extend through the baffle and first acoustic damping means into said acoustic damping chamber;

f. exhaust means in said sidewall to permit hot air exhaust from said at least one motor to exit said second interior compartment; and g. air intake means in said sidewall to permit cooling air to enter said acoustic damping chamber;

h. whereby said first acoustic damping means and said second acoustic damping means reduce the noise emitted from said at least one motor.

16. An improved power unit for a vacuum cleaning system in accordance with claim 15 wherein said first acoustic damping means is acoustic foam and said second acoustic damping means is acoustic foam.

17. An improved power unit for a vacuum cleaning system in accordance with claim 16 wherein said acoustic foam of said first acoustic damping means is approximately one-half inch thick and said acoustic foam of said second acoustic damping means is approximately one-half inch thick.

18. An improved power unit for a vacuum cleaning system in accordance with claim 15 wherein said exhaust means is at least one exhaust port located in said sidewall and extending into said second interior compartment at a location remote from where said at least one motor and armature is located.

19. An improved power unit for a vacuum cleaning system in accordance with claim 15 wherein said exhaust means is a pair of vertically aligned exhaust ports, each of which is located in said sidewall and extending into said second interior compartment at a location remote from where said at least one motor and armature is located.

20. An improved power unit for a vacuum cleaning system in accordance with claim 15 wherein said air intake means are louvres in the sidewall at the location of said acoustic damping chamber.

21. An improved power unit for a vacuum cleaning system including a canister having a sidewall, a top and a bottom hollow section, a first interior hollow compartment housing a removable dirt and dust collection receptacle which causes dirt and dust to fall into the bottom hollow section and including a partition base which separates the first interior hollow compartment from a second interior compartment located near the top of said canister and which houses at least one motor and armature interiorly extending therefrom, with the at least one motor emitting noise when the at least one motor is turned on, the improvement comprising:

a. first damping means defining one end of said second interior compartment to thereby house said at least one motor between said partition base and the first damping means;

b. second damping means spaced apart from said first damping means whereby said sidewall, said first damping means and said second damping means define an acoustic damping chamber;

c. said first damping means comprising at least one opening to permit a portion of the armature of said at least one motor to extend through said first damping means into said acoustic damping chamber;

d. exhaust means in said sidewall to permit hot air exhaust from said at least one motor to exit said second interior compartment; and e. air intake means in said sidewall to permit cooling air to enter said acoustic damping chamber;

f. whereby said first damping means and said second damping means reduce the noise emitted from said at least one motor.

22. An improved power unit for a vacuum cleaning system in accordance with claim 21 wherein said first damping means further comprises a baffle supporting acoustic foam.

23. An improved power unit for a vacuum cleaning system in accordance with claim 22 wherein said acoustic foam is approximately one-half inch thick.

24. An improved power unit for a vacuum cleaning system in accordance with claim 21 wherein said second damping means further comprises acoustic foam supported on and below said top.

25. An improved power unit for a vacuum cleaning system in accordance with claim 24 wherein said acoustic foam is approximately one-half inch thick.

26. An improved power unit for a vacuum cleaning system in accordance with claim 21 wherein said exhaust means is at least one exhaust port located in said sidewall and extending into said second interior compartment at a location remote from where said at least one motor and armature is located.

27. An improved power unit for a vacuum cleaning system in accordance with claim 21 wherein said exhaust means is a pair of vertically aligned exhaust ports, each of which is located in said sidewall and extending into said second interior compartment at a location remote from where said at least one motor and armature is located.

28. An improved power unit for a vacuum cleaning system in according with claim 21 wherein said air intake means are louvres in the sidewall at the location of said acoustic damping chamber.

29. An improved power unit for a vacuum cleaning system including a canister having a sidewall, a top and a bottom which enclose an interior chamber, an inlet port to receive air from a separate dirt and dust collection means, the interior chamber housing at least one motor and armature extending therefrom, with the at least one motor emitting noise when the at least one motor is turned on, the improvement comprising:

a. a baffle within said canister positioned to divide the interior chamber into a first compartment and a second compartment;
b. first acoustic damping means supported on said baffle;
c. a second acoustic damping means supported on and below said top of said canister;
d. said sidewall, said baffle and said second acoustic damping means defining the bounds of said second compartment to create an acoustic damping chamber;
e. said at least one motor and a portion of said armature located in said first compartment and said baffle and said first acoustic damping means comprising at least one opening to permit a portion of the armature of said at least one motor to extend through the baffle and first acoustic damping means into said acoustic damping chamber;
f. exhaust means in said sidewall to permit hot air exhaust from said at least one motor to exit said first compartment of said interior chamber; and
g. air intake means in said sidewall to permit cooling air to enter said acoustic damping chamber;
h. whereby said first acoustic damping means and said second acoustic damping means reduce the noise emitted from said at least one motor.

30. An improved power unit for a vacuum cleaning system in accordance with claim 29 wherein said first acoustic damping means is acoustic foam and said second acoustic damping means is acoustic foam.

31. An improved power unit for a vacuum cleaning system in accordance with claim 30 wherein said acoustic foam of said first acoustic damping means is approximately one-half inch thick and said acoustic foam of said second acoustic damping means is approximately one-half inch thick.

32. An improved power unit for a vacuum cleaning system in accordance with claim 29 wherein said exhaust means is at least one exhaust port located in said sidewall and extending into said first compartment at a location remote from where said at least one motor and portion of the armature is located.

33. An improved power unit for a vacuum cleaning system in accordance with claim 29 wherein said exhaust means is a pair of vertically aligned exhaust ports, each of which is located in said sidewall and extending into said first compartment at a location remote from where said at least one motor and portion of the armature is located.

34. An improved power unit for a vacuum cleaning system in accordance with claim 29 wherein said air intake means are louvres in the sidewall at the location of said acoustic damping chamber.

35. An improved power unit for a vacuum cleaning system including a canister having a sidewall, a top and a bottom to define an interior chamber, an inlet port to receive air from a separate dirt and dust collection means, a partition base within the interior chamber, the interior chamber housing at least one motor and armature extending therefrom, with the at least one motor emitting noise when the at least one motor is turned on, the improvement comprising:

a. first damping means located within said interior chamber and dividing the interior chamber into a first compartment and second compartment;
b. said at least one motor and a portion of said armature located within said set compartment and set between said partition base and said the first damping means;
c. second damping means spaced apart from said first damping means whereby said sidewall, said first damping means and said second damping means define said second compartment to form an acoustic damping chamber;
d. said first damping means comprising at least one opening to permit a portion of the armature of said at least one motor to extend through said first damping means into said acoustic damping chamber;
e. exhaust means in said sidewall to permit hot air exhaust from said at least one motor to exit said interior chamber; and
f. air intake means in said sidewall to permit cooling air to enter said acoustic damping chamber;
g. whereby said first damping means and said second damping means reduce the noise emitted from said at least one motor.

36. An improved power unit for a vacuum cleaning system in accordance with claim 35 wherein said first damping means further comprises a baffle supporting acoustic foam.

37. An improved power unit for a vacuum cleaning system in accordance with claim 36 wherein said acoustic foam is approximately one-half inch thick.

38. An improved power unit for a vacuum cleaning system in accordance with claim 35 wherein said second damping means further comprises acoustic foam supported on and below said top.

39. An improved power unit for a vacuum cleaning system in accordance with claim 38 wherein said acoustic foam is approximately one-half inch thick.

40. An improved power unit for a vacuum cleaning system in accordance with claim 35 wherein said exhaust means is at least one exhaust port located in said sidewall and extending into said first compartment at a location remote from where said at least one motor and portion of the armature is located.

41. An improved power unit for a vacuum cleaning system in accordance with claim 35 wherein said exhaust means is a pair of vertically aligned exhaust ports, each of which is located in said sidewall and extending into said first at a location remote from where said at least one motor and portion of the armature is located.

42. An improved power unit for a vacuum cleaning system in accordance with claim 35 wherein said air intake means are louvres in the sidewall at the location of said acoustic damping chamber.

* * * * *